US006622713B1

(12) United States Patent
Thomas

(10) Patent No.: US 6,622,713 B1
(45) Date of Patent: Sep. 23, 2003

(54) RAIL GUN

(76) Inventor: Thorizos Thomas, 319 Conyers St., Havana, FL (US) 32333

( * ) Notice: Subject to any disclaimer, the term of this patent is extended or adjusted under 35 U.S.C. 154(b) by 0 days.

(21) Appl. No.: 10/078,105

(22) Filed: Feb. 19, 2002

(51) Int. Cl.[7] ..... F41B 6/00
(52) U.S. Cl. ..... 124/3; 89/8
(58) Field of Search ..... 124/3; 89/8

(56) References Cited

U.S. PATENT DOCUMENTS 2,214,297 A * 9/1940 Ferry ..... 124/3
2,235,201 A * 3/1941 Cole ..... 124/3
4,753,153 A * 6/1988 Jasper, Jr. ..... 89/8
4,901,621 A * 2/1990 Tidman ..... 505/164
4,922,800 A * 5/1990 Hoffman ..... 89/8
4,930,395 A * 6/1990 Loffler ..... 89/8
5,122,506 A * 6/1992 Wang ..... 505/164
5,183,956 A * 2/1993 Rosenberg ..... 89/8
5,189,244 A * 2/1993 Weldon ..... 89/8
5,237,904 A * 8/1993 Kuhlmann-Wilsdorf ..... 89/8
5,272,965 A * 12/1993 Loffler ..... 89/8
5,297,468 A * 3/1994 Dreizin ..... 89/8
5,763,812 A * 6/1998 Collins ..... 89/8
5,993,164 A * 11/1999 Diaz ..... 417/50
6,200,102 B1 * 3/2001 Diaz ..... 417/50

FOREIGN PATENT DOCUMENTS

DE 4002786 * 8/1991

* cited by examiner

*Primary Examiner*—Peter M Poon
*Assistant Examiner*—Troy Chambers
(74) *Attorney, Agent, or Firm*—Peter Loffler

(57) ABSTRACT

A rail gun uses magnetic forces to accelerate a round held within the firing chamber of the gun. A pair of rails extend along a length of the firing chamber and each has at least one wire passing therethrough. At least one toroid magnet encompasses the rails as does a solenoid magnet. The wires within the rails, the toroid magnet and the solenoid magnet are each electrically coupled to an electrical source with electrical communication established by a trigger. A magnetically sensitive round held within the firing chamber is initially accelerated by the rails, then further accelerated by the toroid magnet and then further accelerated by the solenoid magnet prior to being discharged from the firing chamber.

18 Claims, 5 Drawing Sheets

RAIL GUN

BACKGROUND OF THE INVENTION

1. Field of the Invention

The present invention relates to a rail gun that discharges rounds at very high velocities by using electromagnetic fields to accelerate the rounds.

2. Background of the Prior Art

A typical firearm works by inserting a shell having a casing and a round into the gun's firing chamber and causing a hammer to impact on the casing with a high force. The impact causes gun powder held within the casing to explode. The exploding and expanding gases, being able to escape through the open end of the firing chamber, accelerate the round through the firing chamber and out the exit port of the chamber. This system proves effective in operation but is not without its drawbacks.

The acceleration factor in determining the exit velocity of the round is primarily a factor of the force imposed on the round by the exploding gases. As there are practical limits to the forces than can be achieved by the expanding gases, so too are there limits to the exit velocities achievable by the rounds. This results in a limitation in the distance that can be traveled by a round and the force that the round can impart upon impact. In order to increase the force exerted by the round, for instance to be able to penetrate a bullet resistant vest, the size of the round must be increased. While a a bigger round has greater stopping power relative to a smaller round, the bigger round carries its own drawbacks. A bigger round weighs more, as does the casing holding the round and the gun powder held within the casing. This can prove quite burdensome to a soldier who must carry several magazines of ammunition or to a fighter jet that has a threshold weight capacity that must be rationed between rounds, bombs, missiles, and fuel. Additionally, a larger round requires a larger gun from which to be fired, further increasing the weight of the overall system.

If a given round can be discharged at a greater velocity, the force exerted by the round is also increased. Based on the fundamental principle of force, wherein the force of an object is equal to ½. $W.V^2$ wherein W is the weight of the object and V is the velocity of the object, doubling the velocity of a round quadruples the force of the round and also increases the distance that the round can travel before being stopped by the frictional resistance imposed by air. Increasing the velocity tenfold, increases the force of the round one hundred fold. Accordingly, increasing the velocity of the fired round decreases the size of the round needed, as well as the size of the firing weapon used, in order to achieve a desired level of force impacted by the round on a subject target.

In order to overcome the limits imposed by gas-based firing systems, other round acceleration systems have been proposed. One type of firing system that has received wide attention is an electromagnetic-based firing system. Such a system relies on the use of electromagnets that act upon the round, which is made from a magnetically sensitive material, in order to accelerate the round using magnetic forces created by the electromagnets. As such systems rely on the use of magnetic fields to perform the acceleration, exit velocities of the rounds can be made to surpass the corresponding gun powder-based systems. However, the current electromagnetic-based firearms, are either too complex in design and construction, making such firearms expensive to manufacture and relatively easy to fail when subjected to the rigors of the environment in which the firearms serve, or the firearms rely on a large amount of electrical energy in order use, requiring the user to carry a large and bulky battery negating any weight savings achieved by using a smaller round.

Therefore, there exist a need in the art for an electromagnetic-based firearm system that uses magnetic forces to accelerate a round through and out a barrel of a firearm and that overcomes the above-stated problems associated with prior art devices. Such a firearm system must be of relatively simple design and construction and must be relatively easy to use and not be prone to failure in the field even if handled in rough manner. The firearm system must be electrically stingy so as not to require a large amount of electricity to use so that a user is not required to maintain a large and bulky battery or other electrical source.

SUMMARY OF THE INVENTION

The rail gun system of the present invention addresses the aforementioned needs in the art. The rail gun system uses magnetic forces to accelerate a magnetically sensitive round, which round is case less, through and out a barrel of a firearm at a high velocity relative to a corresponding gunpowder-based firearm. The rail gun system is of relatively simple design and construction and is relatively easy to use. The rail gun system is not readily prone to failure in the field even during rough maneuvers. The rail gun system is electrically stingy in that it does not require a large amount of electricity to use relieving the user from having to maintain a large and bulky battery or other electrical source to power the rail gun system.

The rail gun system of the present invention is comprised of a body member and a firing chamber, having an inlet port and a discharge port, the firing chamber being attached to the body member. A pair of generally coextensive rails extends along a length of the firing chamber and are attached to the firing chamber in spaced-apart fashion. A plurality of wires, which may be made from copper or other appropriate conducting material, are provided and each wire passes through a respective one of the rails. At least one toroid magnet encompasses a first portion of the outer periphery of the rails while a solenoid magnet encompasses a second portion of the outer periphery of the rails, the solenoid magnet being disposed between the toroid magnet and the discharge port. An electrical source is electrically coupled to the wires, the toroid magnet and the solenoid magnet. A trigger is attached to the body member for selectively establishing electrical communication between the source of electricity and the wires, the toroid magnet and the solenoid magnet. The electrical source comprises a battery such as a lithium ion battery, which is rechargeable. The rails, the toroid magnet, and the solenoid magnet are each made from a permanent magnet, advantageously a rare earth permanent magnet such as NdFeB or SmCo. A caseless round is fired from the firing chamber such that the round is placed into the inlet port and is accelerated by the rails, the toroid magnet and the solenoid magnet and is thereafter discharged through the discharge port. The round is made from an appropriate magnetically sensitive material such as aluminum and can have C-4 explosive disposed within the round. A loading mechanism is provided for loading a round into the firing chamber through the inlet port whenever the round within the firing chamber is discharged. The loading mechanism can be configured to discontinue electrical communication between the electrical source and the rails, the toroid magnet and the solenoid magnet as the loading mechanism loads the round into the firing chamber, requiring articulation of the trigger to reestablish the electrical communication. A sight scope can be attached to the body member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
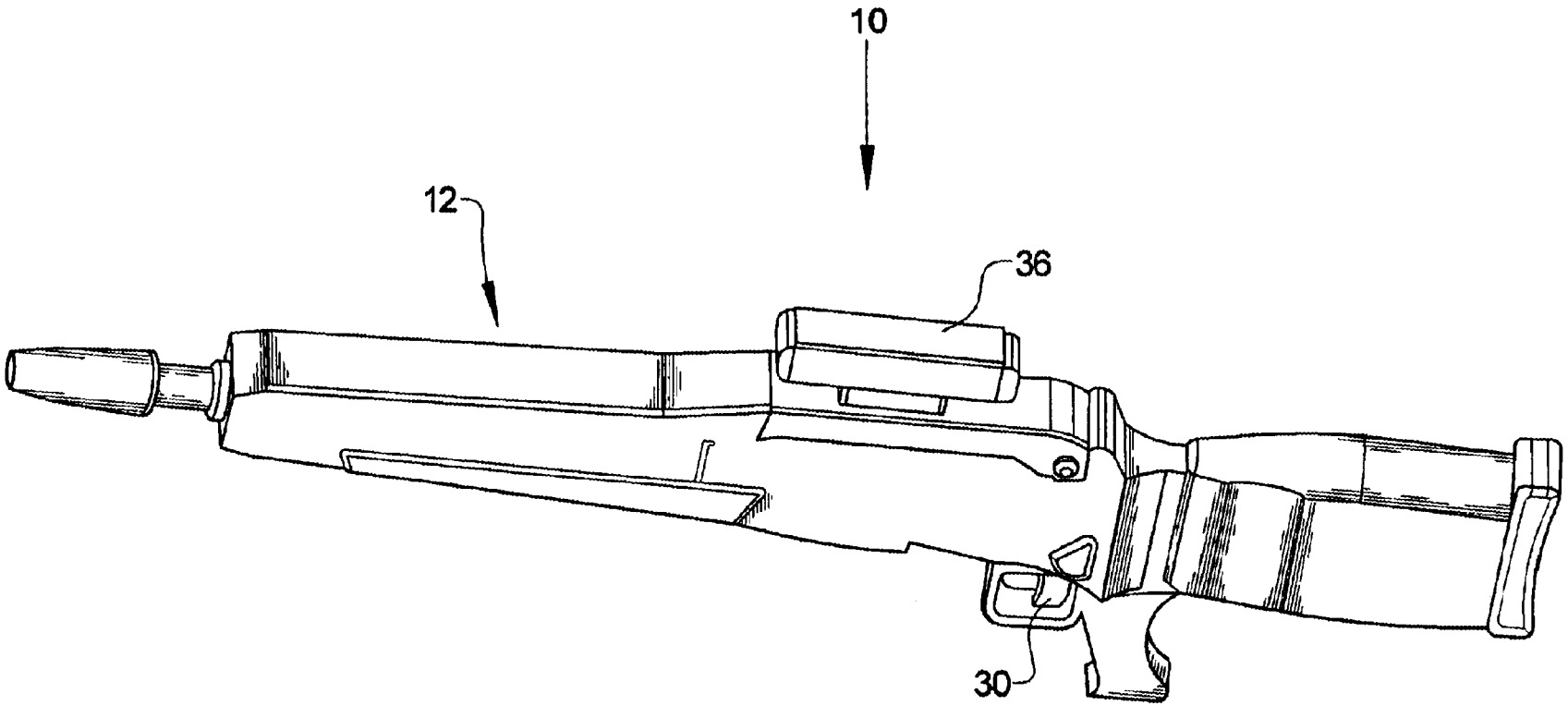
FIG. 1 is a perpective view of the rail gun of the present invention.
Figure 2:
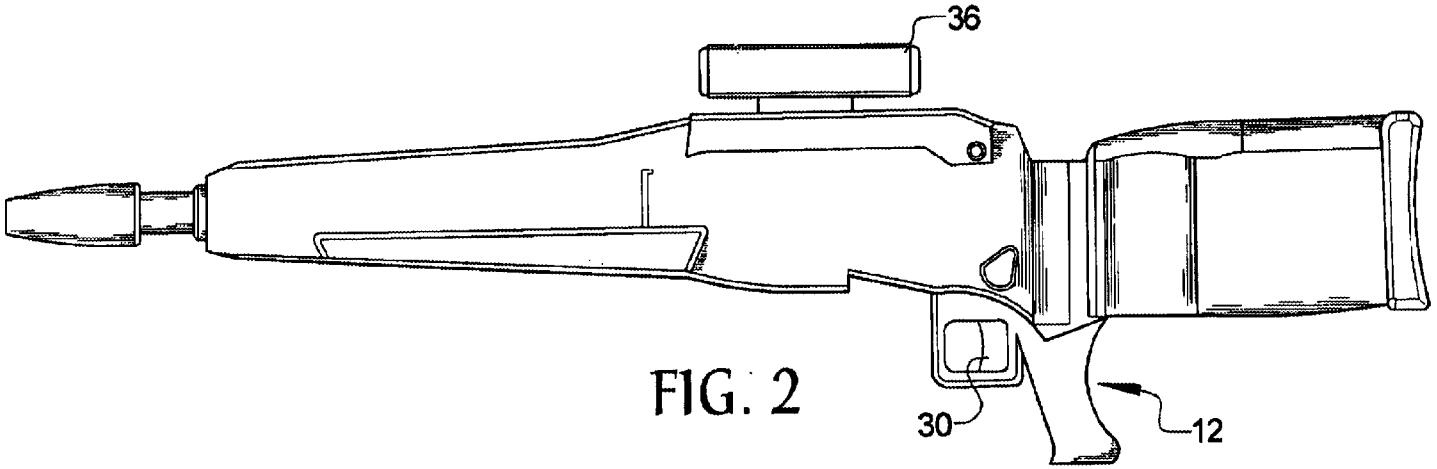
FIG. 2 is a right side elevation view of the rail gun.
Figure 5:
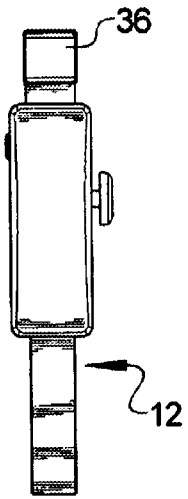
FIG. 5 is a rear elevation view of the rail gun.
Figure 4:
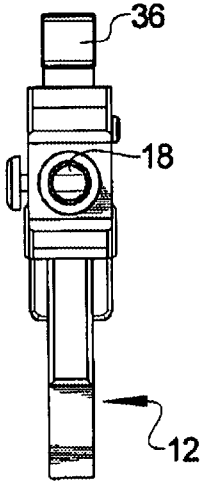
FIG. 4 is a front elevation view of the rail gun.
Figure 6:
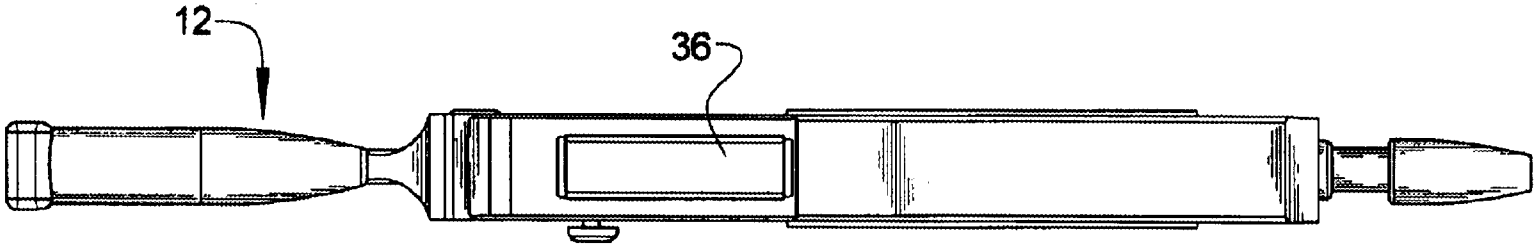
FIG. 6 is a top plan view of the rail gun.
Figure 3:
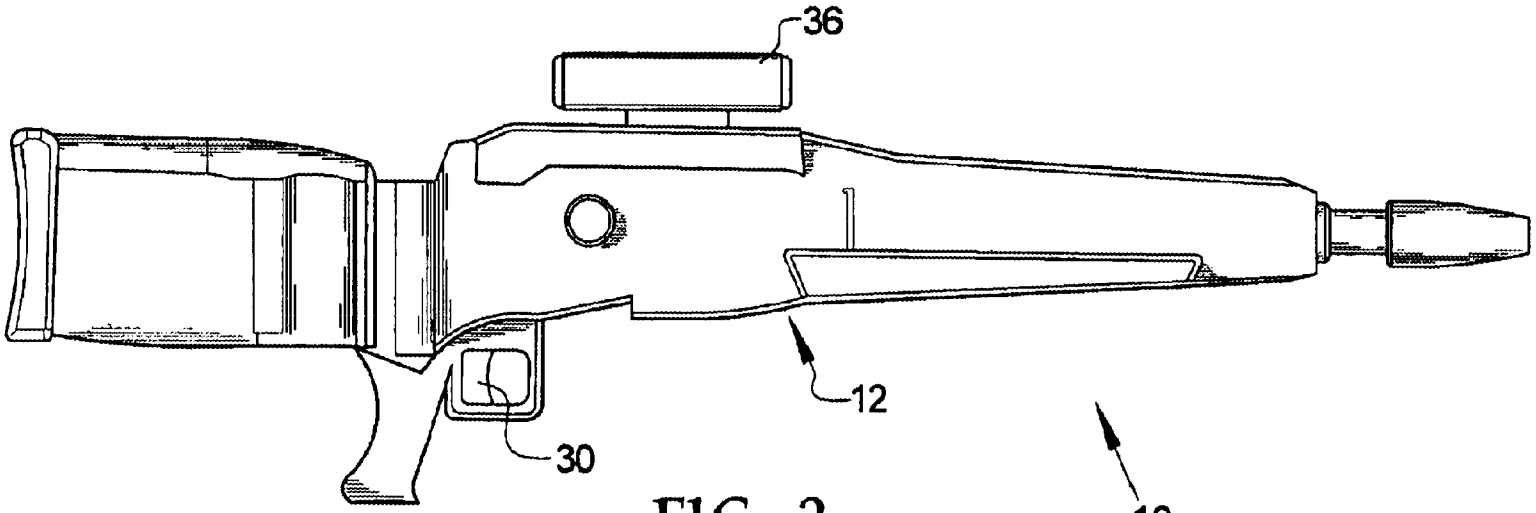
FIG. 3 is a left side elevation view of the rail gun.
Figure 7:
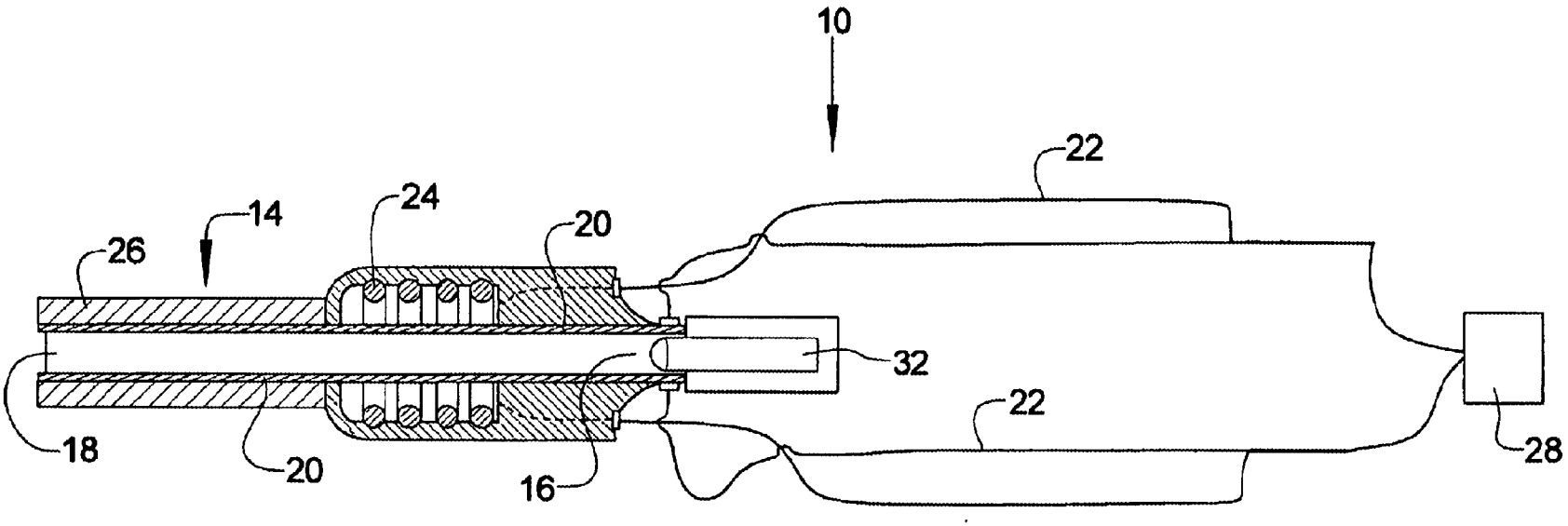
FIG. 7 is a schematic view of the electro-magnetic subsystem of the rail gun of the present invention.
Figure 8:
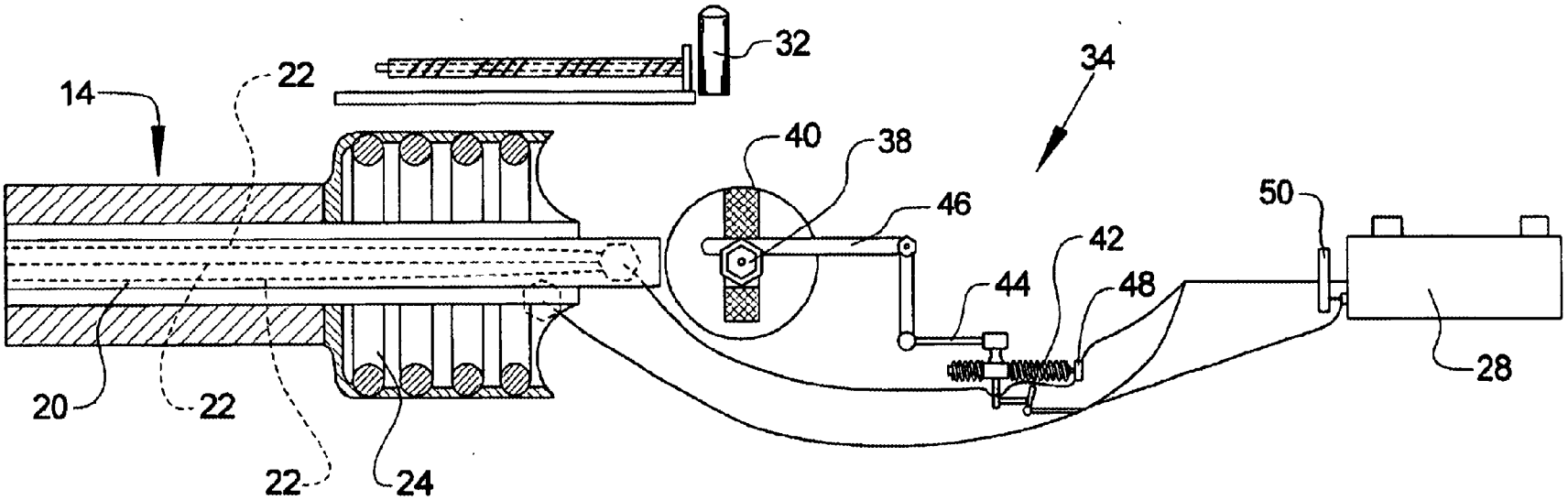
FIG. 8 is close-up view of the loading system of the rail gun.

Referring now to the drawings, it is seen that the rail gun, generally denoted by reference numeral 10, is comprised of a body member 12 which can be any appropriate rifle body stock for firearm use. A firing chamber 14, having an inlet port 16 and a discharge port 18, is attached to the body member 12. A pair of generally coextensive rails 20 extends along a length of the firing chamber 14 and are attached within the firing chamber 14 in spaced-apart fashion. A plurality of wires 22, which may be made from copper or other appropriate conducting material, are provided and each wire 22 passes through a respective one of the rails 20. Passing three wires 22 through each rail 20 has be been shown to produce positive results. At least one toroid magnet 24 encompasses a first portion of the outer periphery of the rails 20. Using a five toroid magnets 24 has be shown to produce positive results. A solenoid magnet 26 encompasses a second portion of the outer periphery of the rails 20, the solenoid magnet 26 being disposed between the toroid magnet 24 and the discharge port 18 of the firing chamber 14. The rails 20, the toroid magnet 24, and the solenoid magnet 26 are each made from a permanent magnet, advantageously a rare earth permanent magnet such as NdFeB or SmCo.

An electrical source 28 is electrically coupled to the wires 22, the toroid magnet 24 and the solenoid magnet 26. A trigger 30 is attached to the body member 12 for selectively establishing electrical communication between the source of electricity 28 and the wires 22, the toroid magnet 24 and the solenoid magnet 26. The electrical source 28 comprises a battery such as a lithium ion battery, which is rechargeable in any standard fashion.

A round 32 is fired from the firing chamber 14 such that the round 32 is placed into the inlet port 16 and is accelerated by the rails 20, the toroid magnet 24 and the solenoid magnet 26 and is thereafter discharged through the discharge port 18. The round 32, which is case less, is made from an appropriate magnetically sensitive material such as aluminum and can have C-4 explosive disposed within the round 32.

A loading mechanism 34 is provided for loading a new round 32 into inlet port 16 of the firing chamber 14 whenever the round 32 within the firing chamber 14 discharged. The loading mechanism 34 can be configured to discontinue electrical communication between the electrical source 28 and the rails 20, the toroid magnet 24 and the solenoid magnet 26 as the loading mechanism 34 loads the round 32 into the firing chamber 14, requiring articulation of the trigger 30 to reestablish the electrical communication.

Specifically, the loading mechanism 34, which is similar to the loading mechanism found on a G11 assault rifle manufactured by the Heckler and Koch Corporation, comprises a clip 36 which holds a plurality of rounds 32 in standard fashion. The rounds 32 are loaded into the clip 36 by twisting the unloading controller knob 38. Once the rounds 32 are loaded within the clip 36, the clip 36 is mounted to the rail gun 10 and is held thereat in standard fashion. The round 32 to be fired is further loaded within a cylindrical roller 40 wherein the cylindrical roller 40 is disposed at a 180 degree angle relative to the longitudinal axis of the firing chamber 14. Once the trigger 30 is pulled a first spring 42 is compressed which compresses a first spring 42 and a first firing pen 44. The first firing pen 44 articulates a second firing pen 46 which compresses a switch 48 found on the circuit board 50 that controls the electrical system of the rail gun 10. This causes electricity to flow from the electrical source 28 through the wires 22 and to the toroid magnet 24 and the solenoid magnet 26. As the second firing pen 46 returns to its original position, the second firing pen 46 acts on the round 32 and positions the round 32 into the inlet port 16 of the firing chamber 14. The magnetic forces produced by passing electricity through the wires 22 within the rails 20 act on the round 32 and accelerate the round 32 through the firing chamber 14 wherein the round 32 is acted on up by the magnetic forces created by the toroid magnet 24 act on the round 32 and further accelerate the round 32 down the firing chamber 14. Thereafter, the round 32 is acted on by the magnetic forces created by the solenoid magnet 26 which magnetic forces further accelerate the round 32 before the round 32 is discharged from the outlet port 18 of the firing chamber 14. Meanwhile, the returning second firing pen 46 decouples from the switch 48 thereby terminating electrical communication between the electrical source 28 and the wires 22, the toroid magnet 24, and the solenoid magnet 26. The returning second firing pen 46 also tangentially acts on the roller 40, causing the roller 40 to rotate 90 degrees thereby loading the next round 32 to be fired into the roller 40, before the roller 40 returns to its original perpendicular position. The rail gun 10 is again in its initial state and ready to be fired again.

A sight scope can be attached to the body member 12.

While the invention has been particularly shown and described with reference to an embodiment thereof, it will be appreciated by those skilled in the art that various changes in form and detail may be made without departing from the spirit and scope of the invention.

I claim:

1. A rail gun system comprising:

a body member;

a firing chamber, having an inlet port and a discharge port, attached to the body member;

a pair of generally coextensive rails extending along a length of the firing chamber attached to the firing chamber in spaced-apart fashion;

a plurality of wires, each wiring passing through a respective one of the rails;

at least one toroid magnet encompassing a first portion of the outer periphery of the rails;

a solenoid magnet encompassing a second portion of the outer periphery of the rails, disposed between the toroid magnet and the discharge port;

an electrical source electrically coupled to the wires, the toroid magnet and the solenoid magnet; and a trigger for selectively establishing electrical communication between the source of electricity and the wires, the toroid magnet and the solenoid magnet.

2. The rail gun as in claim 1 wherein the wires are made from copper.

3. The rail gun as in claim 1 wherein the electrical source comprises a battery.

4. The rail gun as in claim 3 wherein the battery is rechargeable.

5. The rail gun as in claim 1 wherein the electrical source comprises a lithium ion battery.

6. The rail gun as in claim 1 wherein the rails are each made from a permanent magnet.

7. The rail gun as in claim 1 wherein the rails are each made from NdFeB.

8. The rail gun as in claim 1 wherein the toroid magnet is made from a permanent magnet.

9. The rail gun as in claim 1 wherein the toroid magnet is made from NdFeB.

10. The rail gun as in claim 1 wherein the solenoid magnet is made from a permanent magnet.

11. The rail gun as in claim 1 wherein the solenoid magnet is made from NdFeB.

12. The rail gun as in claim 1 in combination with a round wherein the round is placed into the inlet port and is accelerated by the rails, the toroid magnet and the solenoid magnet and is thereafter discharged through the discharge port.

13. The rail gun as in claim 12 wherein the round is made from aluminum.

14. The rail gun as in claim 13 further comprising C-4 explosive disposed within the round.

15. The rail gun as in claim 12 further comprising C-4 explosive disposed within the round.

16. The rail gun as in claim 12 further comprising a loading mechanism for loading a round into the firing chamber through the inlet port whenever the round within the firing chamber is discharged.

17. The rail gun as in claim 16 wherein the loading mechanism discontinues electrical communication between the electrical source and the rails, the toroid magnet and the solenoid magnet as the loading mechanism loads the round into the firing chamber, requiring articulation of the trigger to reestablish the electrical communication.

18. The rail gun as in claim 1 further comprising a sight scope attached to the body member.

* * * * *

UNITED STATES PATENT AND TRADEMARK OFFICE

CERTIFICATE OF CORRECTION

PATENT NO. : 6,622,713 B1
APPLICATION NO. : 10/078105
DATED : September 23, 2003
INVENTOR(S) : Thomas It is certified that error appears in the above-identified patent and that said Letters Patent is hereby corrected as shown below:

Title page item (76) "Thorizos" should read --Torrizos--

Signed and Sealed this

Fourth Day of August, 2009

JOHN DOLL
*Acting Director of the United States Patent and Trademark Office*